US006565183B2

(12) United States Patent
Goto et al.

(10) Patent No.: US 6,565,183 B2
(45) Date of Patent: May 20, 2003

(54) INK JET RECORDING APPARATUS

(75) Inventors: Fumitaka Goto, Yokohama (JP); Masami Amemiya, Tokyo (JP); Hajime Yamamoto, Yokohama (JP); Hideyuki Sugioka, Ebina (JP); Kenji Shinjo, Yokohama (JP); Toshihiko Bekki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/839,022

(22) Filed: Apr. 23, 2001

(65) Prior Publication Data

US 2002/0005872 A1 Jan. 17, 2002

(30) Foreign Application Priority Data

Apr. 28, 2000 (JP) ..... 2000-129359

(51) Int. Cl.[7] ..... B41J 2/165
(52) U.S. Cl. ..... 347/22; 347/104
(58) Field of Search ..... 347/22–36, 104, 347/3; 355/24

(56) References Cited

U.S. PATENT DOCUMENTS 5,376,957 A * 12/1994 Gandy et al. ..... 347/3
5,896,143 A * 4/1999 Matsui et al. ..... 347/24

FOREIGN PATENT DOCUMENTS

| | | |
|---|---|---|
| JP | 57-178758 | 11/1982 |
| JP | 59-31178 | 2/1984 |
| JP | 10-76713 | 3/1998 |

* cited by examiner

*Primary Examiner*—Judy Nguyen
*Assistant Examiner*—Ly T Tran
(74) *Attorney, Agent, or Firm*—Fitzpatrick, Cella, Harper & Scinto

(57) ABSTRACT

An ink jet recording apparatus includes a conveying device for conveying a recording sheet, a first recording device for discharging ink to a first surface of the recording sheet conveyed by the conveying device to thereby record an image thereon, a second recording device for discharging ink to a second surface opposite to the first surface of the recording sheet conveyed by the conveying device, a first ink receiving device disposed at the first surface side of the recording sheet for receiving the ink discharged from the second recording device, and a second ink receiving device disposed at the second surface side of the recording sheet for receiving the ink discharged from the first recording device.

19 Claims, 15 Drawing Sheets

INK JET RECORDING APPARATUS

BACKGROUND OF THE INVENTION

1. Field of the Invention

This invention relates to an ink jet recording apparatus, and particularly to an ink jet recording apparatus for effecting recording on both sides of a recording medium.

2. Related Background Art

Heretofore, many recording apparatuses for ordinary users could effect only one-side recording, and when both-side recording is to be effected on a postcard or the like, recording has been effected on both sides by a user turning the recording sheet over and feeding it after one-surface recording. Also, both-side recording decreases recording sheets required for recording to half and can curtail the space for keeping recording sheets and further is useful for environmental protection and therefore, the demand for it has heightened.

So, in recent years, various recording apparatuses have been proposed in order to make both-side recording possible. For example, in Japanese Patent Publication No. 3-24350, etc., there is described a recording apparatus in which a recording sheet on which one-side recording has been effected is once discharged and reversed, and thereafter is re-fed to a recording portion, whereby recording is also effected on the other surface. Also, in Japanese Patent Application Laid-Open No. 57-178758, Japanese Patent Application Laid-Open No. 10-76713, etc., there are described recording apparatuses in which recording heads are disposed at both sides of a recording sheet and recording is effected on both surfaces of the recording sheet.

However, in the aforedescribed recording apparatus according to the prior art in which the recording sheet is re-fed, a mechanism for reversing the recording sheet is complicated and requires a bulky apparatus. Also, it suffers from the problem that a time for reversing the recording sheet is required and therefore the time for both-side recording becomes long.

Also, the construction in which recording heads are disposed at both sides of the recording sheet suffers from the problem that blankless recording cannot be effected by recording means of the ink jet type.

SUMMARY OF THE INVENTION

It is an object of the present invention to provide an ink jet recording apparatus which can effect recording on both sides of a recording sheet at a time and can effect blankless recording irrespective of both-side recording or one-side recording.

It is another object of the present invention to provide an ink jet recording apparatus having conveying means for conveying a recording sheet, first recording means for discharging ink to a first surface of the recording sheet conveyed by the conveying means to thereby record an image thereon, second recording means for discharging ink to a second surface opposite to the first surface of the recording sheet conveyed by the conveying means to thereby record an image thereon, a first ink receiving device disposed at the first surface side of the recording sheet for receiving the ink discharged from the second recording means, and a second ink receiving device disposed at the second surface side of the recording sheet for receiving the ink discharged from the first recording means.

DESCRIPTION OF THE PREFERRED EMBODIMENTS

First Embodiment

Figure 1:
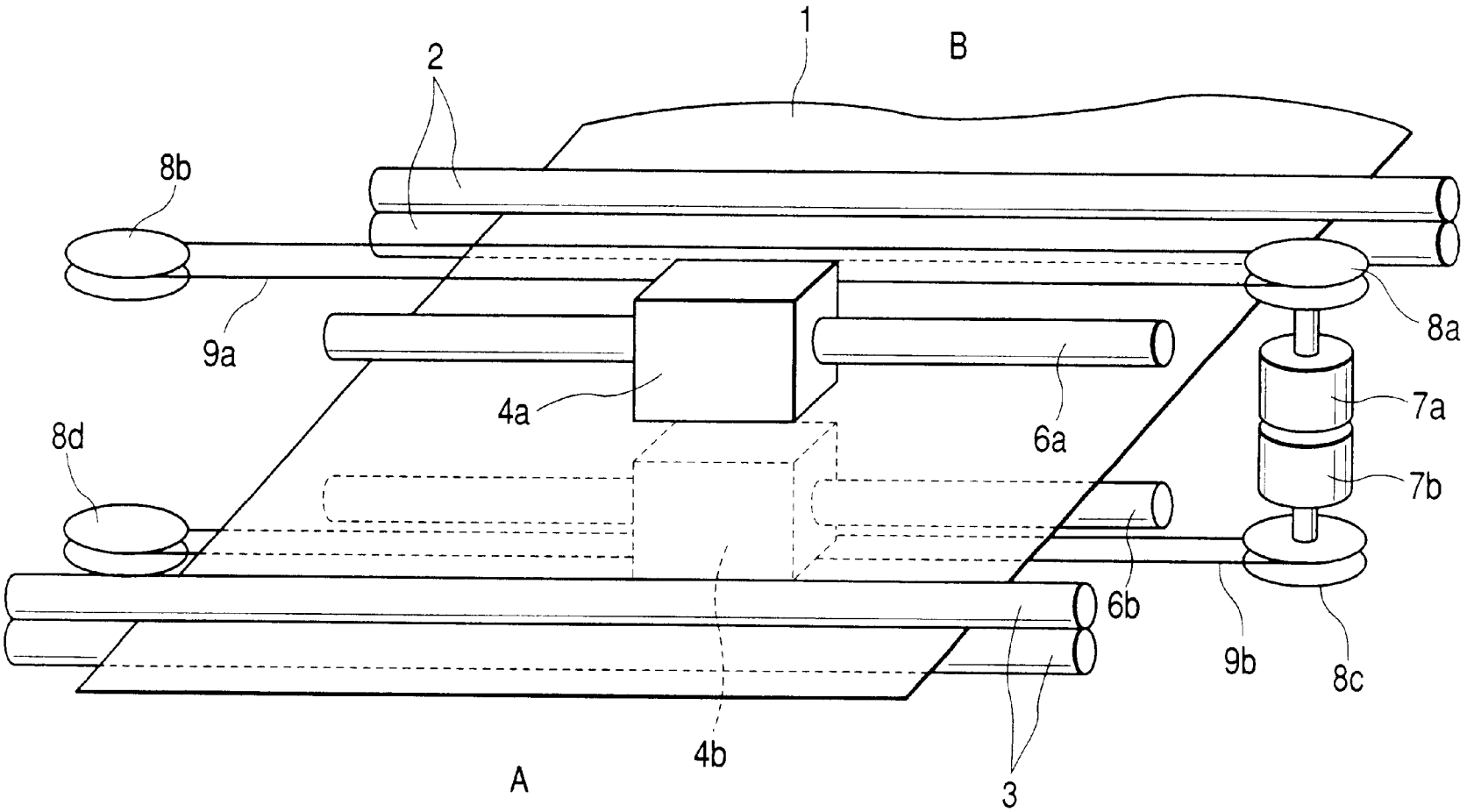
FIG. 1 is a schematic cross-sectional view of a recording apparatus according to a first embodiment of the present invention.
Figure 2:
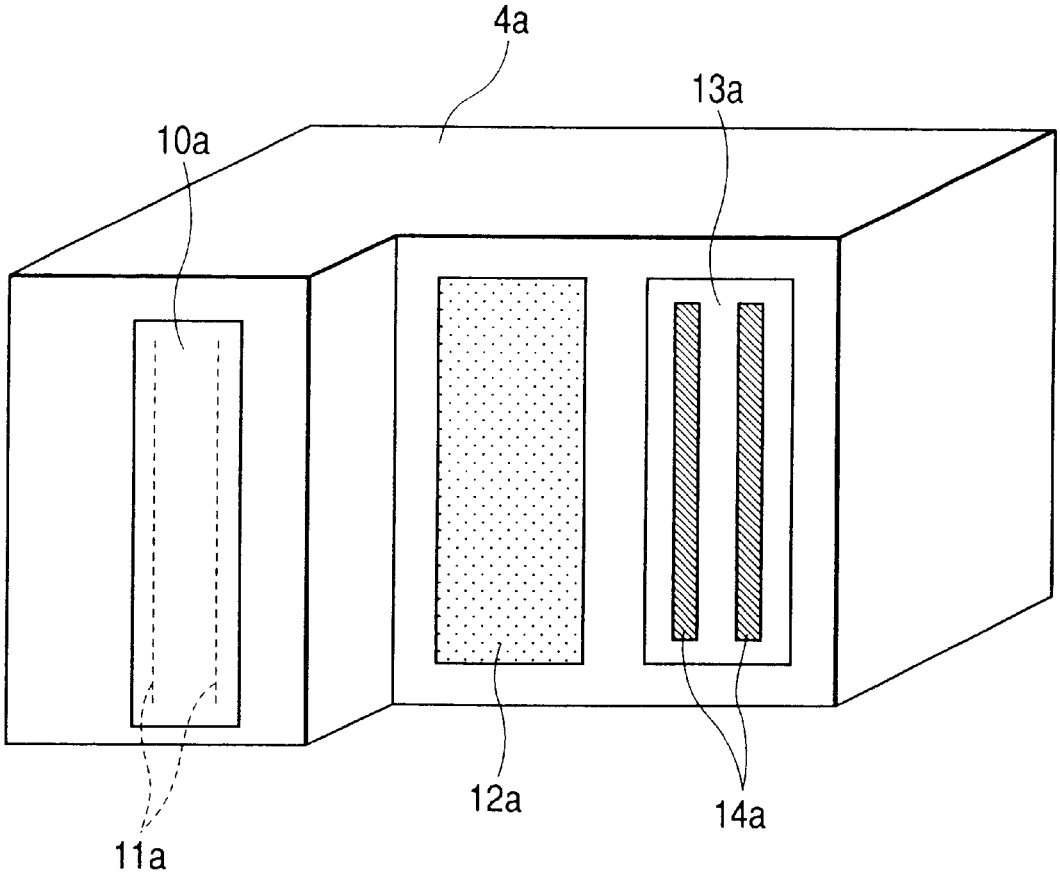
FIG. 2 illustrates a recording cartridge.
Figure 3:
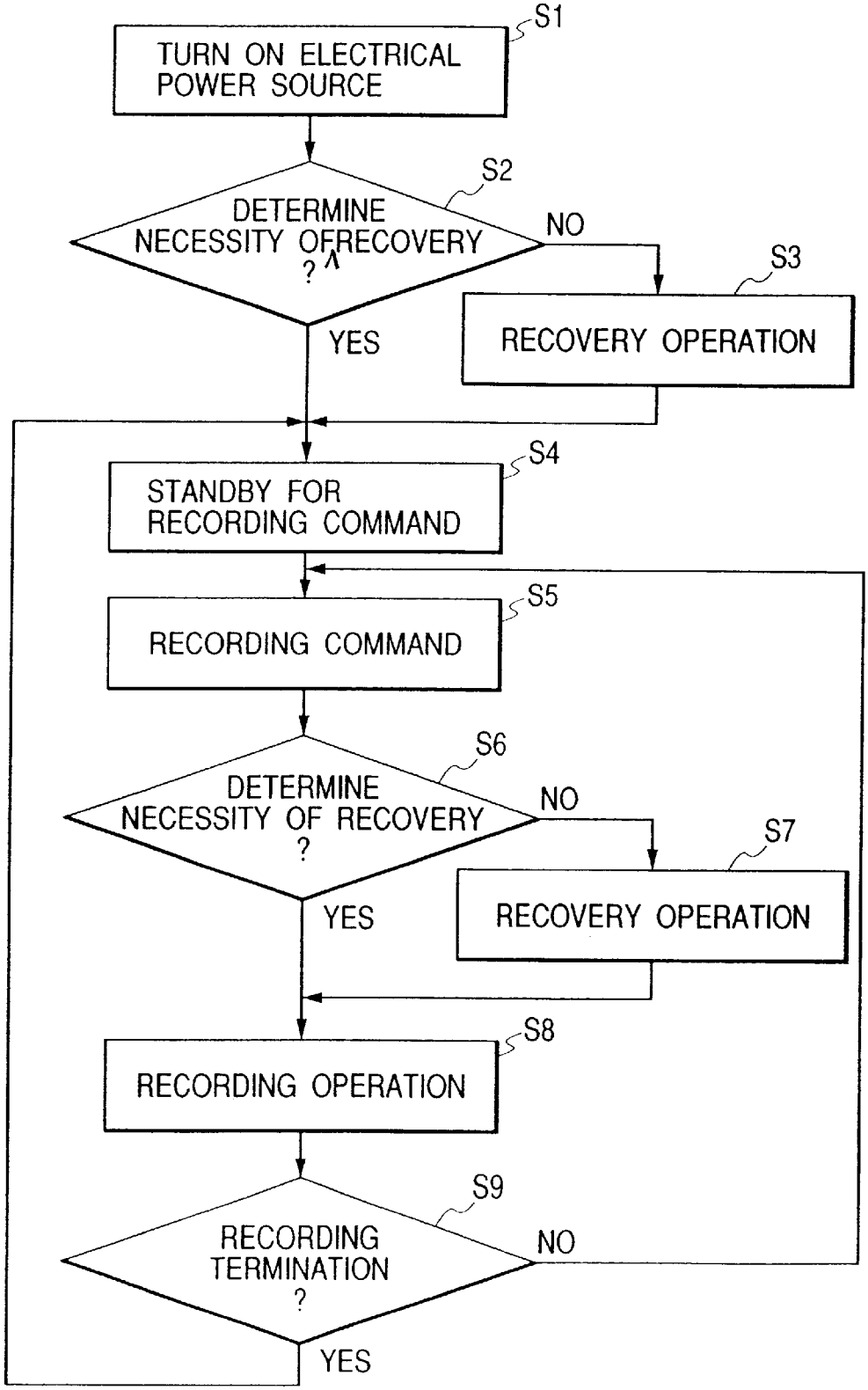
FIG. 3 is a flow chart illustrating a general operation.
Figure 4A:
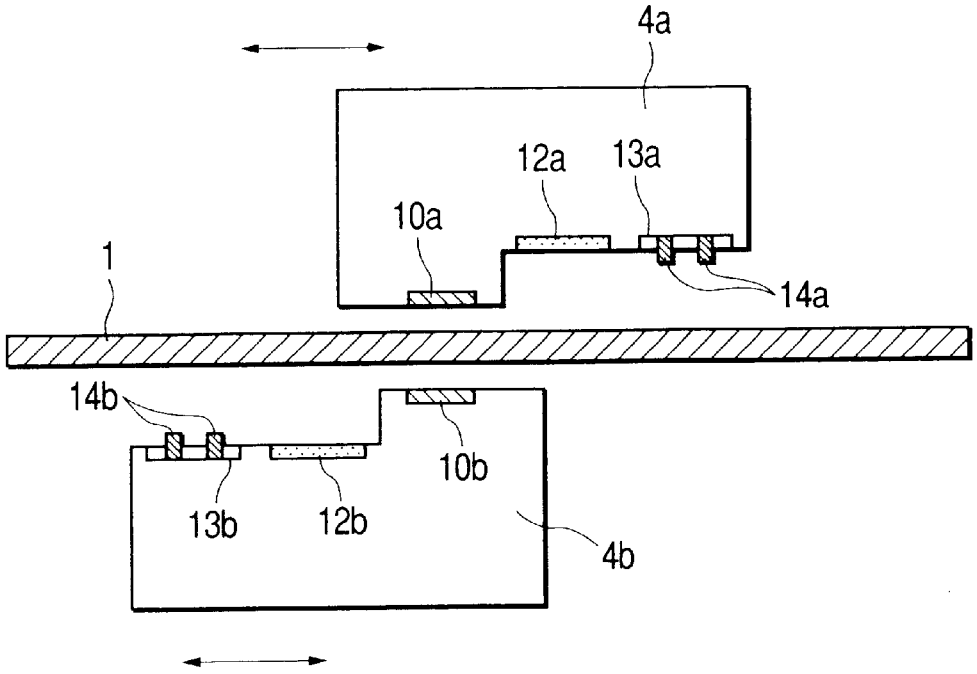
FIGS. 4A and 4B illustrate the recording operation by the recording cartridge.
Figure 4B:
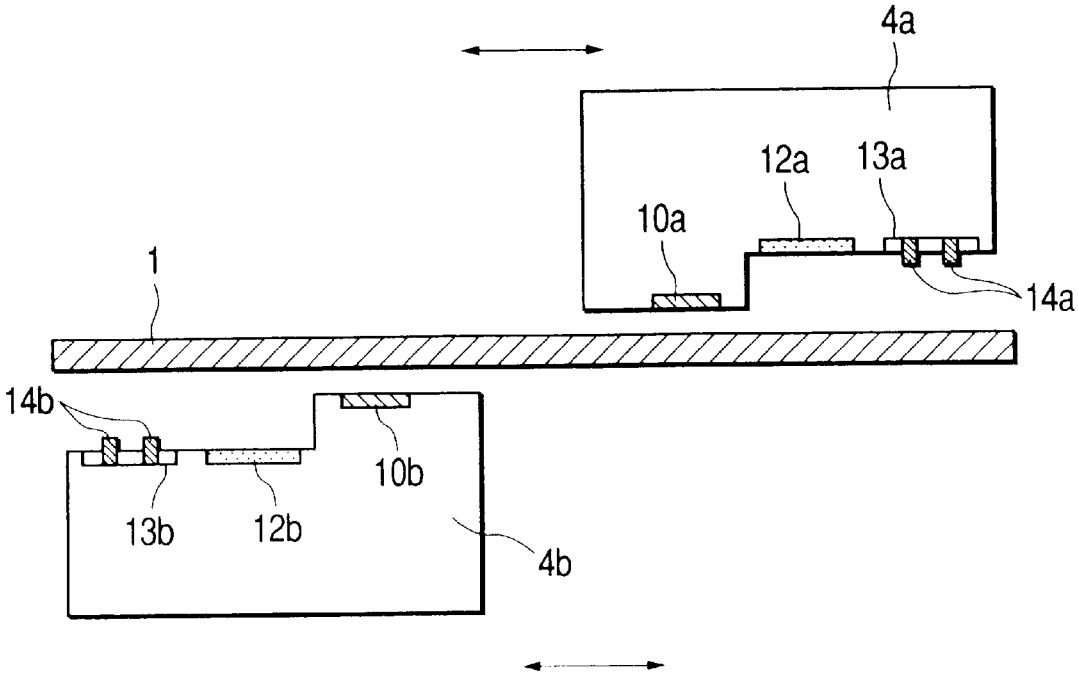
Figure 5:
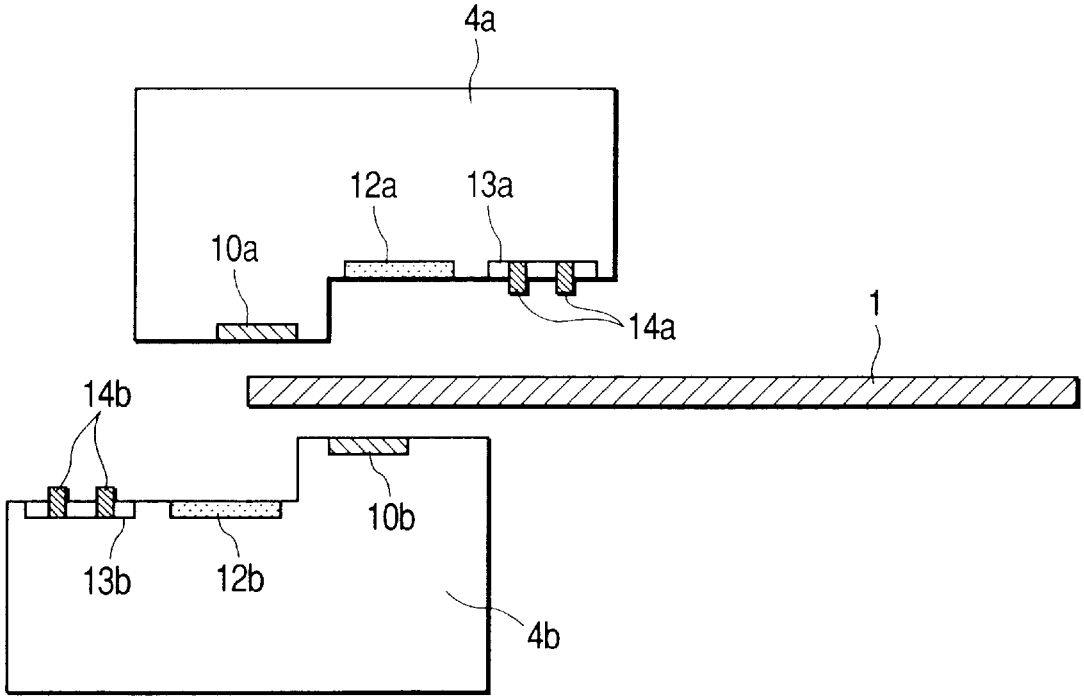
FIG. 5 illustrates recording on an end portion of a recording sheet.
Figure 6:
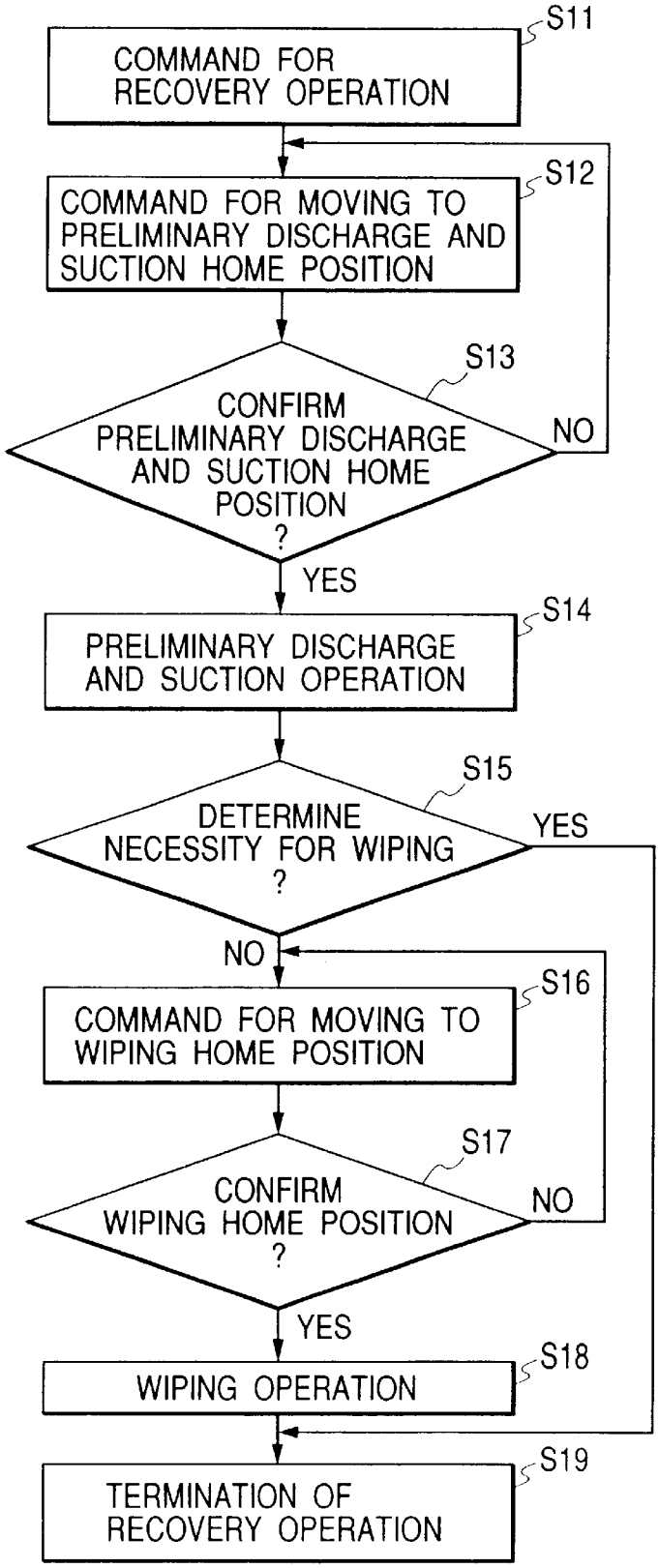
FIG. 6 is a flow chart showing a recovery sequence.
Figure 7A:
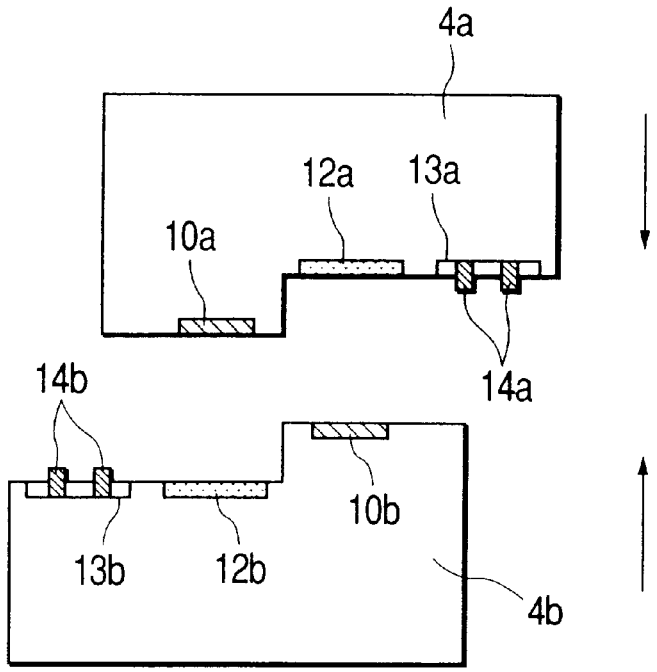
FIGS. 7A and 7B are illustrations showing the preliminary discharge or suction operation.
Figure 7B:
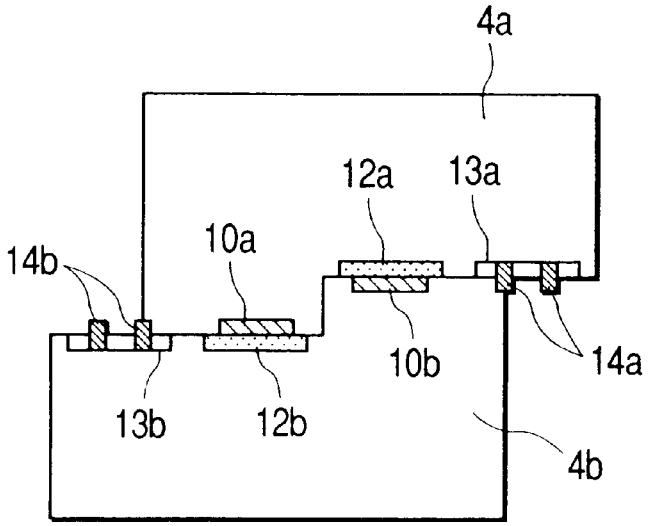
Figure 8A:
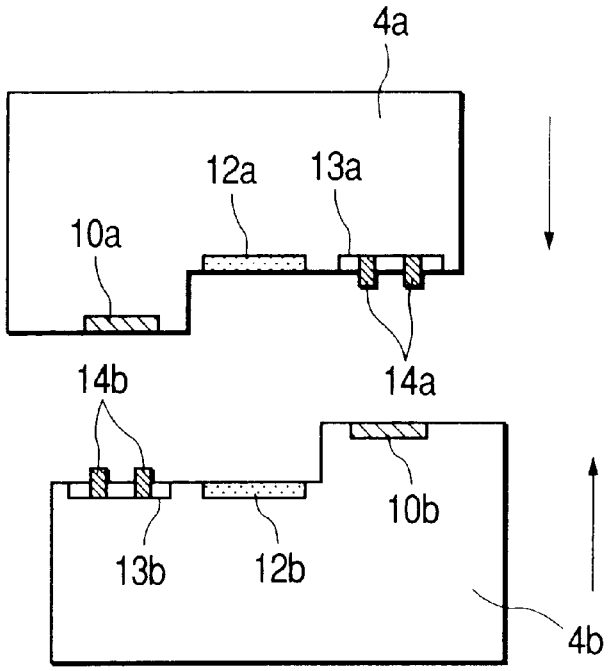
FIGS. 8A and 8B are illustrations showing the wiping operation.
Figure 8B:
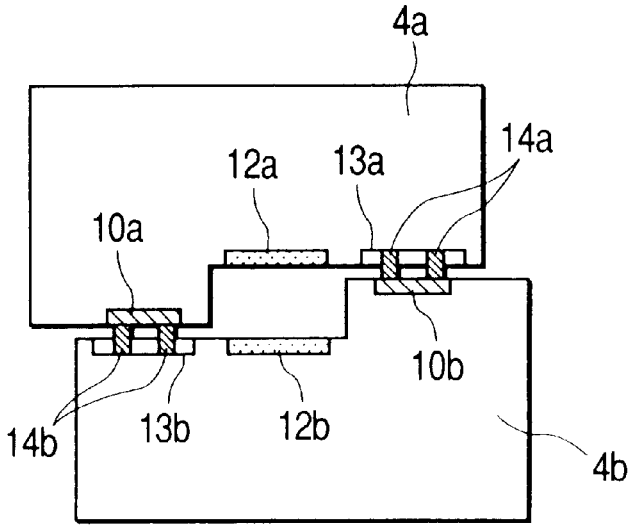

A recording apparatus according to a first embodiment of the present invention will hereinafter be described. FIG. 1 schematically shows the construction of the recording apparatus according to the first embodiment, FIG. 2 illustrates a recording cartridge, FIG. 3 is a flow chart illustrating a general operation, FIGS. 4A and 4B illustrate the recording operation by the recording cartridge, FIG. 5 illustrates recording on an end portion of a recording sheet, FIG. 6 is a flow chart showing a recovery sequence, FIGS. 7A and 7B are illustrations showing the preliminary discharge or suction operation, and FIGS. 8A and 8B are illustrations showing the wiping operation.

(Apparatus Construction)

FIG. 1 illustrates a recording apparatus of the ink jet type for recording an image on a recording sheet 1 comprising paper or a plastic sheet. A plurality of such recording sheets 1 are stacked in a cassette or the like, and are fed one by one by a feed roller, not shown. The recording sheets may then be conveyed in the direction from B toward A in FIG. 1 by a pair of first conveying rollers 2 and a pair of second conveying rollers 3 disposed at a predetermined interval and driven independently of each other.

Recording cartridges 4*a* and 4*b* of the ink jet type for effecting recording on the recording sheet 1 are disposed at the front and back sides of the recording sheet 1 conveyed by the pair of first conveying rollers 2 and the pair of second conveying rollers 3. The recording cartridges 4*a* and 4*b* are provided with recording heads 10*a* and 10*b* which are recording means, and ink recovery devices, respectively. The ink recovery devices, as will be described later, are comprised of ink receiving devices 12*a*, 12*b* and wiping devices 13*a*, 13*b* (see FIG. 2).

The recording cartridges 4*a* and 4*b* are carried on carriages, not shown, and are slidably mounted on guide shafts 6*a* and 6*b*, respectively. Carriage motors 7*a* and 7*b* are connected to these carriages through belts 9*a*, 9*b* and pulleys 8*a*, 8*b*, 8*c*, 8*d*. Accordingly, by the driving of the carriage motors 7*a* and 7*b*, the carriages are designed to be capable of reciprocally scanning along the guide shafts 6*a* and 6*b* in the main scanning direction intersecting with the direction of conveyance of the recording sheet 1 (the sub-scanning direction).

FIG. 2 is a perspective view of the recording cartridge 4*a*. Ink is supplied to the recording head 10*a* of the recording cartridge 4*a*, and the ink is discharged from the ink discharge ports 11*a* of the recording head 10*a* in conformity with image data to thereby effect image recording. The ink discharge ports 11*a* are arranged in the direction of conveyance of the recording sheet. The ink receiving device 12*a* is a preliminary discharge receiving or suction device, and the wiping device 13*a* has a wiper 14*a*. Although not shown, the recording cartridge 4*b* is of a similar construction.

(Recording Means)

The recording heads 10*a* and 10*b* which are recording means serve to record an image on the recording sheet conveyed by the conveying means. As the recording means in this recording apparatus, use is made of the ink jet recording type for discharging the ink from the recording head to thereby effect recording. That is, this recording head is provided with minute liquid discharge ports (orifices), a liquid path and an energy acting portion provided in a portion of this liquid path, and energy generating means for generating liquid droplet forming energy for acting on the liquid in the acting portion.

As the energy generating means for generating such energy, there is a recording method using an electromechanical converting member such as a piezoelectric element, a recording method using energy generating means for applying an electromagnetic wave such as a laser and generating heat, and discharging liquid droplets by the action of the generated heat, or a recording method using energy generating means for heating liquid by an electrothermal converting member such as a heat generating element having a heat generating resistor and discharging the liquid.

Among these, a recording head used in the ink jet recording method of discharging the liquid by heat energy enables liquid discharge ports (orifices) for discharging the liquid for recording therethrough to thereby form liquid droplets for discharge to be arranged highly densely and can therefore effect recording of high resolution. Among them, a recording head using an electro-thermal converting member as energy generating means is easy to make compact and is easy to mount highly densely and is low in manufacturing cost and is therefore advantageous.

In the present embodiment, the ink discharging construction is designed such that the electro-thermal converting member is electrically energized in conformity with a recording signal and by the growth and contraction of a bubble created in the ink by the utilization of film boiling caused to the ink by the heat energy thereof, the ink is discharged from the discharge ports to thereby effect recording.

(General Operation)

When an image is to be recorded by the recording apparatus of the above-described construction, the ink is discharged in conformity with image data while the recording cartridges 4*a* and 4*b* are moved, and each time an image corresponding to one line is recorded, the recording sheet 1 is conveyed in the direction from B toward A by an amount corresponding to one line, and by this being repeated, predetermined images are recorded on both sides of the recording sheet 1. Also, the recording cartridges 4*a* and 4*b* are returned to their home positions as required even during recording and are recovered from the clogging of the ink discharge ports 11*a* and 11*b* by the ink recovery devices.

The operation of the recording apparatus will now be described with reference to FIG. 3. When an electric power source is first turned on (step 1), whether the recovery operation should be performed is checked (step 2). If the recovery is not necessary, a recording command is waited for (step 4), and if the recovery is necessary, a recording command is waited for (step 4) after the recovery operation (step 3). When the recording command is output (step 5), whether the recovery operation should be performed is checked again (step 6). If the recovery is not necessary, the recording operation is intactly performed (step 8), and if the recovery is necessary, the recording operation (step 8) is performed after the recovery operation (step 7). The steps 5 to 9 are repeated until the termination of the recording command (step 9), and when the recording command is terminated, the next recording command is waited for (step 4).

When recording is to be effected on both sides of the recording sheet 1, as shown in FIG. 4, the recording cartridges 4*a* and 4*b* reciprocally scan in the main scanning direction (the direction of arrow in FIG. 4), and at that time, the ink is discharged from the ink discharge ports 11*a* and 11*b* of the recording heads 10*a* and 10*b*, respectively, whereby image recording is effected on the recording sheet 1.

The recording cartridges 4*a* and 4*b* may be moved in the same direction or may be moved in opposite directions. Also, as shown in FIG. 4A, the recording heads 10*a* and 10*b* may be at the same position or, as shown in FIG. 4B, they may be at different positions.

However, design is made such that when recording is to be effected on an end portion of the recording sheet 1, for example, when as shown in FIG. 5, the recording head 10*a* of the recording cartridge 4*a* is to record on an end portion of the recording sheet 1, the ink receiving device 12*b* of the recording cartridge 4*b* is at a position opposed to the recording head 10*a* of the recording cartridge 4*a* so as to receive that part of the ink discharged by the recording head 10*a* which has been discharged to the outside of the recording sheet 1. Thereby, the ink discharged to the outside of the recording sheet can be prevented from adhering to other regions, and blankless recording can be made possible.

Likewise, when the recording head 10*b* of the recording cartridge 4*b* is to record on an end portion of the back of the recording sheet 1, the ink receiving device 12*a* of the recording cartridge 4*a* is at a position opposed thereto, whereby blankless recording can also be effected on the back of the recording sheet. In FIGS. 4A, 4B and 5, the recording sheet 1 is being conveyed in a direction perpendicular to the plane of the drawing sheets.

(Recovery Operation)

As described above, the ink receiving devices 12*a*, 12*b* and the wiping devices 13*a*, 13*b* together constitute the ink recovery devices of the ink jet recording apparatus. As described in connection with FIG. 3, when the recovery operation is judged to be necessary (step 2) or when the user designates the recovery operation, the states of the ink discharge ports 11*a* and 11*b* of the recording heads 10*a* and 10*b*, respectively, are recovered by the recovery devices.

The recovery operation will hereinafter be described with reference to FIGS. 6, 7A, 7B, 8A and 8B. When a command for the recovery operation (step 11) is first put out, a command for moving to the preliminary discharge and suction home position is put out to the recording cartridges 4*a* and 4*b* (step 12), and the recording cartridges 4*a* and 4*b* are moved to their positions as shown in FIG. 7A. At this time, the recording cartridges are moved while it is confirmed that the recording head 10*a* of the recording cartridge 4*a* and the ink receiving device 12*b* of the recording cartridge 4*b* are opposed to each other and likewise, the recording head 10*b* and the ink receiving device 12*a* are opposed to each other (step 13).

When the movement is completed, the recording cartridges 4*a* and 4*b* change from the state of FIG. 7A to a state as shown in FIG. 7B wherein they are close to each other. In this state, the ink receiving device 12*b* of the recording cartridge 4*b* comes into close contact with the recording head 10*a* of the recording cartridge 4*a*, and the ink receiving device 12*a* of the recording cartridge 4*a* comes into close contact with the recording head 10*b* of the recording cartridge 4*b*.

The recording heads 10*a* and 10*b* are then recovered by the ink receiving devices 12*b* and 12*a* of the other recording cartridges (step 14). That is, the recording heads 10*a* and 10*b* of the recording cartridges 4*a* and 4*b*, respectively, effect preliminary discharge to the ink receiving devices 12*b* and 12*a* of the other recording cartridges, and the ink receiving devices 12*b* and 12*a* of the recording cartridges 4*b* and 4*a*, respectively, effect ink suction from the recording heads 10*a* and 10*b* of the other recording cartridges.

Both of preliminary discharge and suction may be effected as described above, or only one of them may be effected. Preliminary discharge may be effected with the recording head 10 of the recording cartridge and the ink receiving device 12 of the other recording cartridge being not in close contact with each other as shown in FIG. 7A.

Next, the necessity for wiping is determined (step 15), and a command for the moving of the recording cartridges 4*a* and 4*b* to the wiping home position is output (step 16). The recording cartridges 4*a* and 4*b* are moved to the positions as shown in FIG. 8A. At this time, they are moved while it is confirmed that the recording head 10*a* of the recording cartridge 4*a* and the wiping device 13*b* of the recording cartridge 4*b* are opposed to each other, and the recording head 10*b* of the recording cartridge 4*b* and the wiping device 13*a* of the recording cartridge 4*a* are opposed to each other (step 17).

When the movement is completed, the recording cartridges 4*a* and 4*b* come close to each other as shown in FIG. 8B from the state of FIG. 8A, and the wiper 14*a* of the recording cartridge 4*a* comes into contact with the recording head 10*b* of the recording cartridge 4*b*, and the wiper 14*b* of the recording cartridge 4*b* comes into contact with the recording head 10*a* of the recording cartridge 4*a*. In this state, the recording head 10 of one recording cartridge 4 is wiped by the wiper 14 of the other recording cartridge 4 (step 18). By the termination of the wiping, the sequence of the recovery operation is terminated (step 19).

While in the above-described embodiment, the recording head, the ink receiving device and the wiping device have been shown as being provided on an integral recording cartridge, the recording heads, the ink receiving devices, etc. may be provided on discrete cartridges, and if at least one recording head, at least one ink receiving device and at least one wiping device are disposed at each side of the recording sheet, the effect of the present invention can be obtained.

Second Embodiment

Figure 9A:
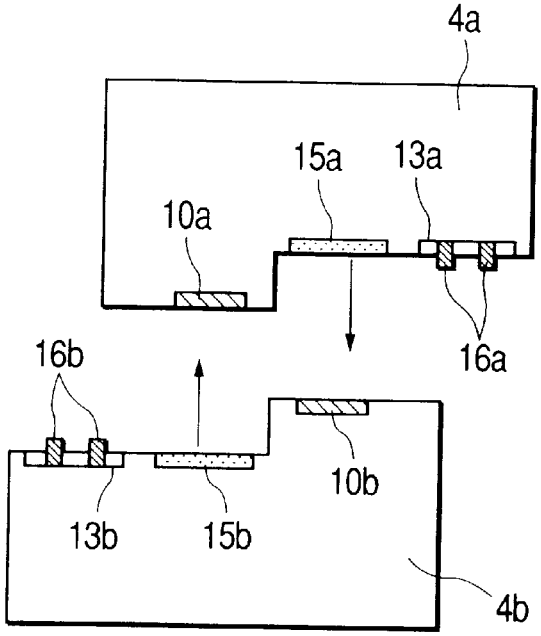
FIGS. 9A and 9B are illustrations showing the preliminary discharge or suction operation according to a second embodiment of the present invention.
Figure 9B:
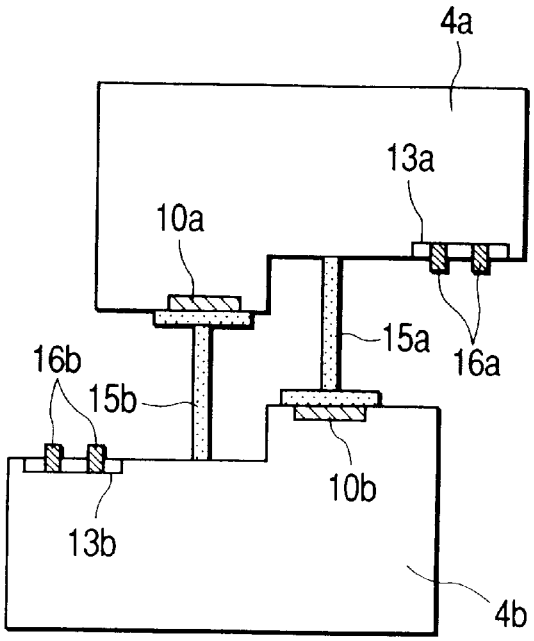
Figure 10A:
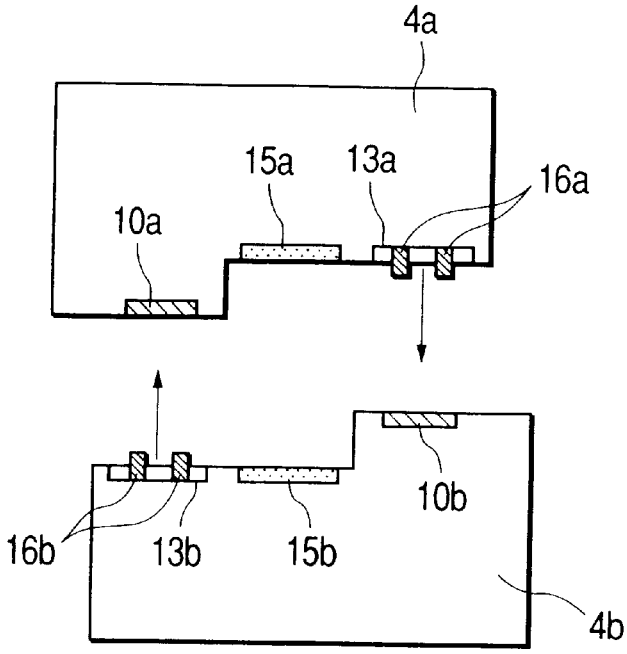
FIGS. 10A and 10B are illustrations showing the wiping operation.
Figure 10B:
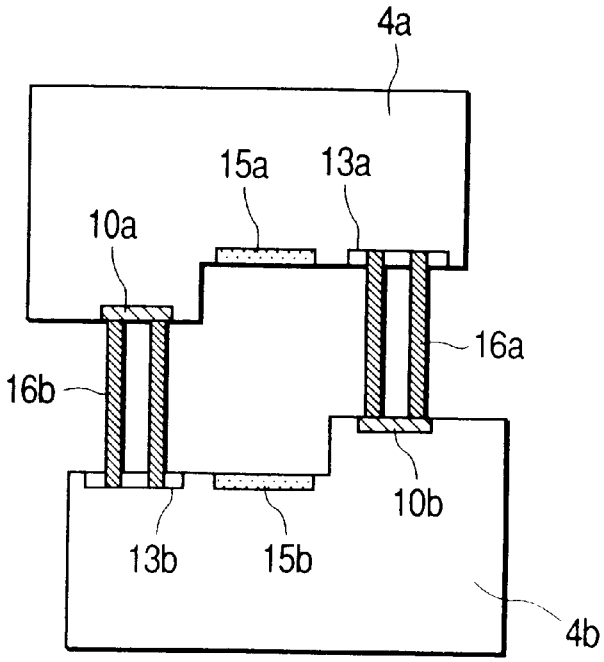

A recording apparatus according to a second embodiment of the present invention will now be described. FIGS. 9A and 9B are illustrations showing the preliminary discharge or suction operation according to the present embodiment, and FIGS. 10A and 10B are illustrations showing the wiping operation, and portions overlapping those of the above-described first embodiment in description are given the same reference characters and need not be described.

In the first embodiment, it has been described that the recording cartridges 4*a* and 4*b* come close to each other to thereby bring the recording head 10*a* and the ink receiving device 12*b* into close contact with each other and bring the recording head 10*b* and the ink receiving device 12*a* into close contact with each other. In the present embodiment, however, ink receiving devices 15*a* and 15*b* are designed to be extendible from the recording cartridges 4*a* and 4*b*, respectively.

Accordingly, from a state as shown in FIG. 9A wherein the recording cartridges 4*a* and 4*b* are opposed to each other at the preliminary discharge and suction position, the ink receiving devices 15*a* and 15*b* provided thereon extend and come into close contact with the recording heads 10*b* and 10*a* of the other recording cartridges 4*b* and 4*a*, and perform the preliminary discharge or suction operation.

Likewise, in the present embodiment, the wipers 16*a* and 16*b* of the wiping devices 13*a* and 13*b*, respectively, are designed to be extendible from the recording cartridges 4*a* and 4*b*. Accordingly, from a state as shown in FIG. 10A wherein the recording cartridges 4*a* and 4*b* are opposed to each other at the wiping home position, the wipers 16*a* and 16*b* provided thereon extend and come into close contact with the recording heads 10*b* and 10*a* of the recording cartridges 4*b* and 4*a*, and perform the wiping operation.

While again in the present embodiment, the recording head, the ink receiving device and the wiping device have been shown as being provided on an integral recording cartridge, the recording heads, the ink receiving devices, etc. may be provided on discrete cartridges, and if at least one recording head, at least one ink receiving device and at least one wiping device are disposed at each side of the recording sheets, the effect of the present invention can be obtained.

Third Embodiment

Figure 11:
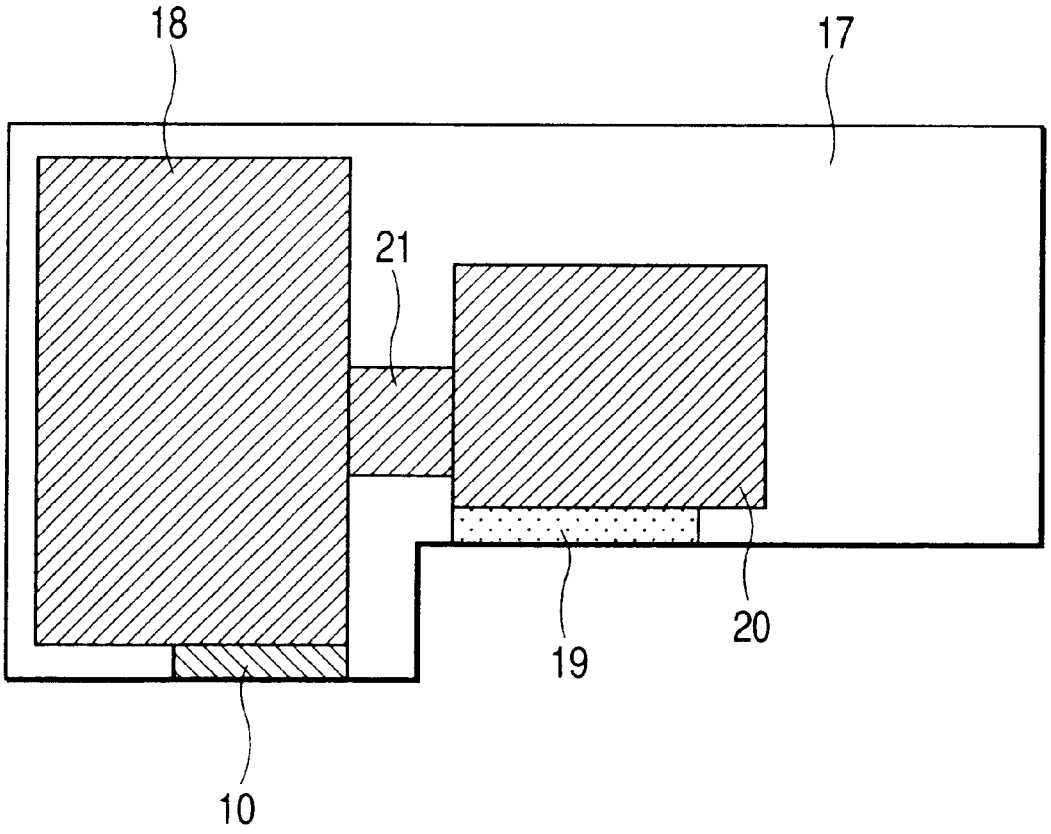
FIG. 11 shows the internal construction of a recording cartridge according to a third embodiment of the present invention.
Figure 12:
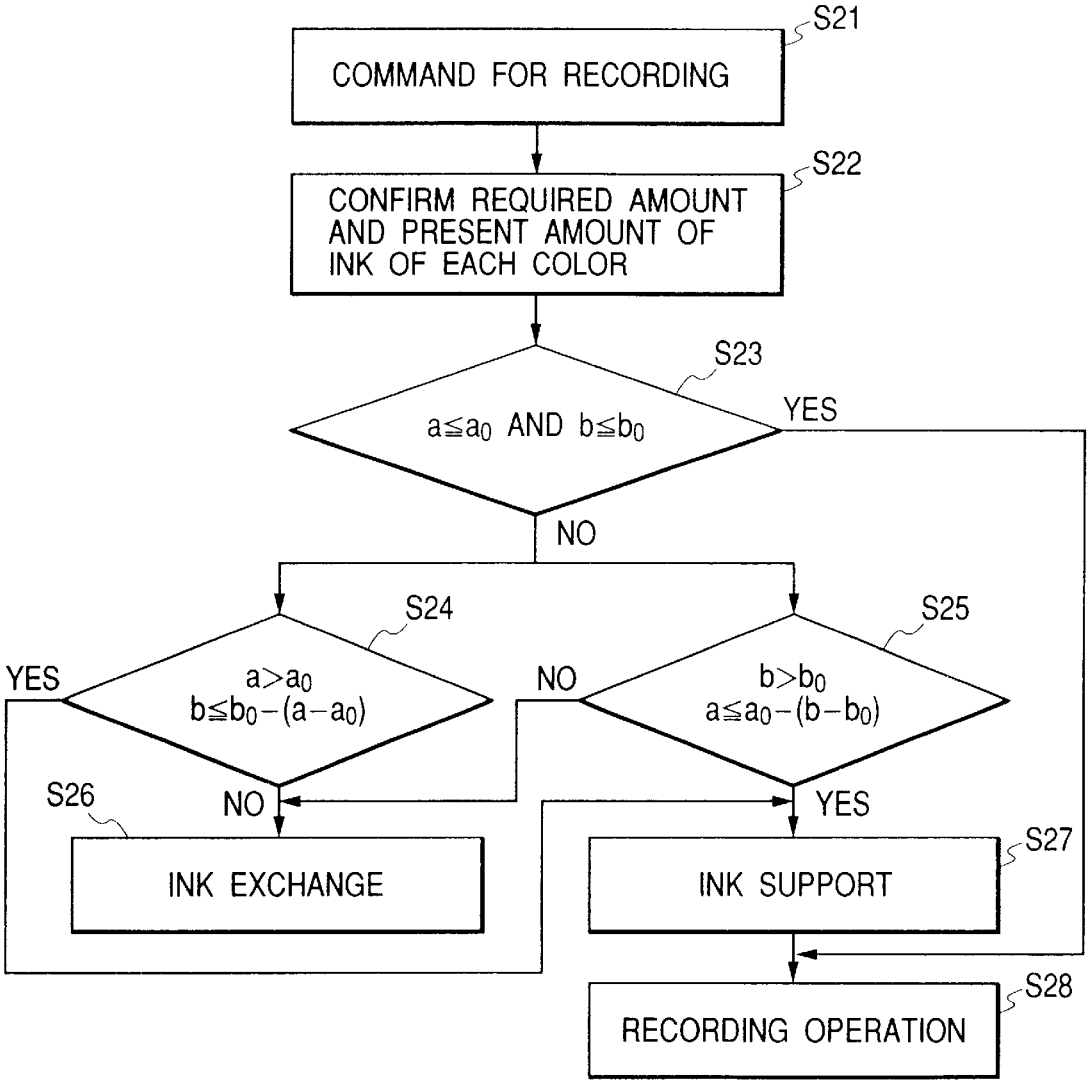
FIG. 12 is a flow chart of mutual ink support.
Figure 13A:
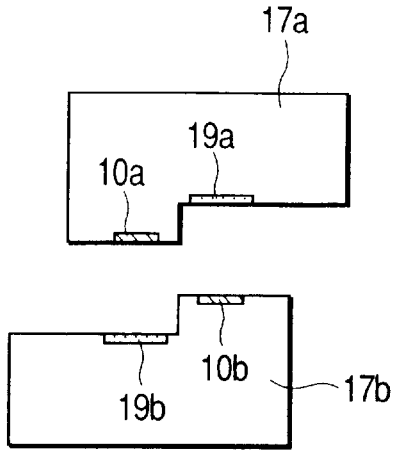
FIGS. 13A, 13B and 13C illustrate the ink support operation.
Figure 13B:
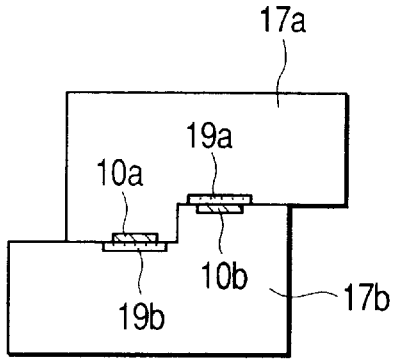
Figure 13C:
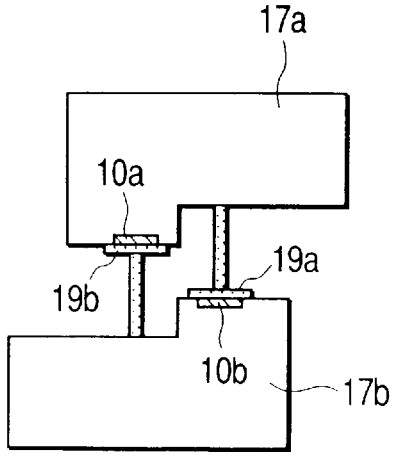
Figure 14:
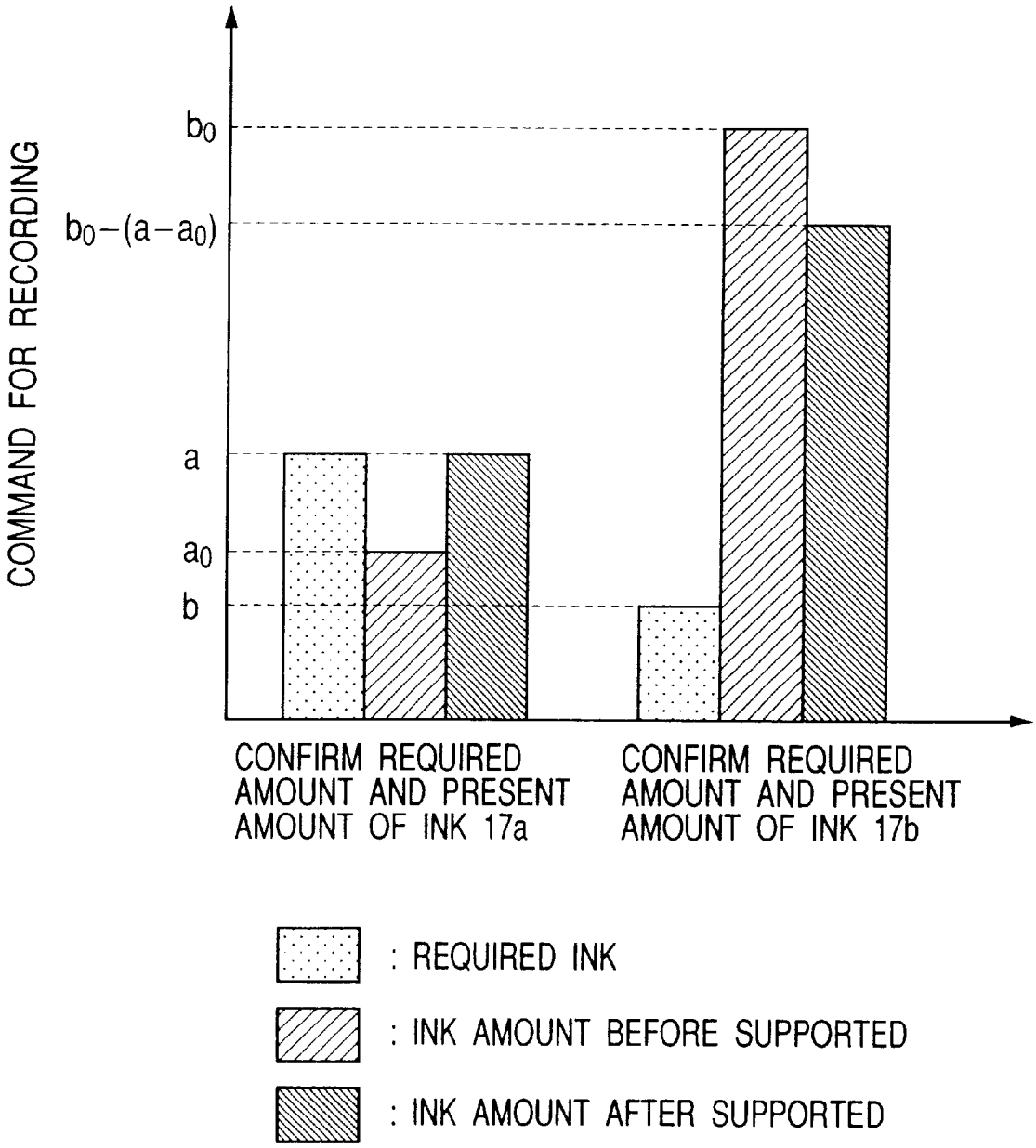
FIG. 14 is an illustration showing the changes in the amount of ink by ink support.

A recording apparatus according to a third embodiment of the present invention will now be described with reference to the drawings. FIG. 11 shows the internal construction of a recording cartridge according to the present embodiment, FIG. 12 is a flow chart of mutual ink support, FIGS. 13A to 13C illustrate the ink support operation, and FIG. 14 is an illustration showing changes in the amount of ink by ink support, and portions overlapping those of the above-described embodiments are given the same reference characters and need not be described.

The recording cartridge 17 shown in FIG. 11 has a recording head 10, an ink tank 18 for supplying ink thereto, an ink receiver 19 which is an ink receiving device according to the present embodiment, and an ink tank 20 connected thereto. The ink tanks 18 and 20 are connected together by a connecting flow path 21, and recording cartridges 17*a* and 17*b* can effect the mutual support of ink through the ink receiver 19, as required.

The mutual support of ink will now be described with reference to FIGS. 12, 13A, 13B and 13C. When a command for recording is first put out (step 21), the amount of ink of each color in each recording cartridge required for recording is confirmed (step 22). The required amount of ink of each color and the present amount of ink of each color are then compared with each other. Here, the required amount of ink in the recording cartridge 17*a* is defined as a, the present amount of ink in the recording cartridge 17*a* is defined as $a_0$, the required amount of ink in the recording cartridge 17*b* is defined as b, and the present amount of ink in the recording cartridge 17*b* is defined as $b_0$.

Comparison between the required amounts of ink a, b and the present amounts of ink $a_0$, $b_0$ is made (step 23). If the present amounts of ink $a_0$ and $b_0$ in the respective recording cartridges are equal to or greater than the required amounts of ink a and b, the recording operation is performed (step 28), and if not so, mutual support check-up is done (step 24 and step 25).

Here, the mutual support check-up will be described with ink of a certain color taken as an example. If in the recording cartridge 17*a*, the required amount of ink a>the present amount of ink $a_0$ and in the recording cartridge 17*b*, the required amount of ink $b \leqq b_0-(a-a_0)$, the ink support from the recording cartridge 17*a* to the recording cartridge 17*b* is done (step 27). Likewise, if in the recording cartridge 17*b*, the required amount of ink $b>b_0$ and in the recording cartridge 17*a*, the required amount of ink $a \leqq a_0-(b-b_0)$, the ink support from the recording cartridge 17*b* to the recording cartridge 17*a* is done (step 27).

The ink support is done with the recording head 10*a* and the ink receiver 19*a*, and the recording head 10*b* and the ink receiver 19*b* being spaced apart from and opposed to each other at the ink support home position, as shown in FIG. 13A, and by the ink flowing from the recording head 10 to the ink receiver 19. Also, the ink support may be done by the ink flowing from the recording head 10 to the ink receiver 19 or the ink being sucked from the recording head 10 by the ink receiver 19 with the recording cartridges 17*a* and 17*b* brought into close contact with each other as shown in FIG. 13B. Also, a similar operation can be performed with the ink receivers 19 being extended from the recording cartridges 17 and without the recording cartridges 17*a* and 17*b* being brought close to each other and with the recording heads 10*a*, 10*b* and the ink receivers 19*a*, 19*b* being brought into close contact with each other, as shown in FIG. 13C.

FIG. 14 shows the changes in the amount of ink when ink support has been done from the recording cartridge 17*b* to the recording cartridge 17*a* (step 24). In the recording cartridge 17*a*, before the support, the amount of ink is deficient by the difference $(a-a_0)$ between the required amount of ink and the present amount of ink, and this is supported from the recording cartridge 17*b*. Thereby the amount of ink in the recording cartridge 17*a* after the support becomes the required amount of ink a, and the amount of ink in the recording cartridge 17*b* becomes $b_0-(a-a_0)$. Similar changes in the amount of ink also occur when the recording cartridges 17*a* and 17*b* are converse.

When in the mutual support check-up (step 24 and step 25), one recording cartridge does not have excess ink enough to supplement the amount of ink deficient in the other recording cartridge, ink exchange (step 26) is effected.

While in the present embodiment, the recording head 10 and the ink receiver 19 have been shown as being provided on an integral recording cartridge, the recording head 10 and the ink receiver may be provided on discrete cartridges, and if at least one recording head and at least one ink receiver are disposed at each side of the recording sheet and the recording head and the ink tank of the ink receiver at the same side with respect to the recording sheet are connected together by a connecting flow path or the like, the effect of the present invention can be obtained.

Fourth Embodiment

Figure 15A:
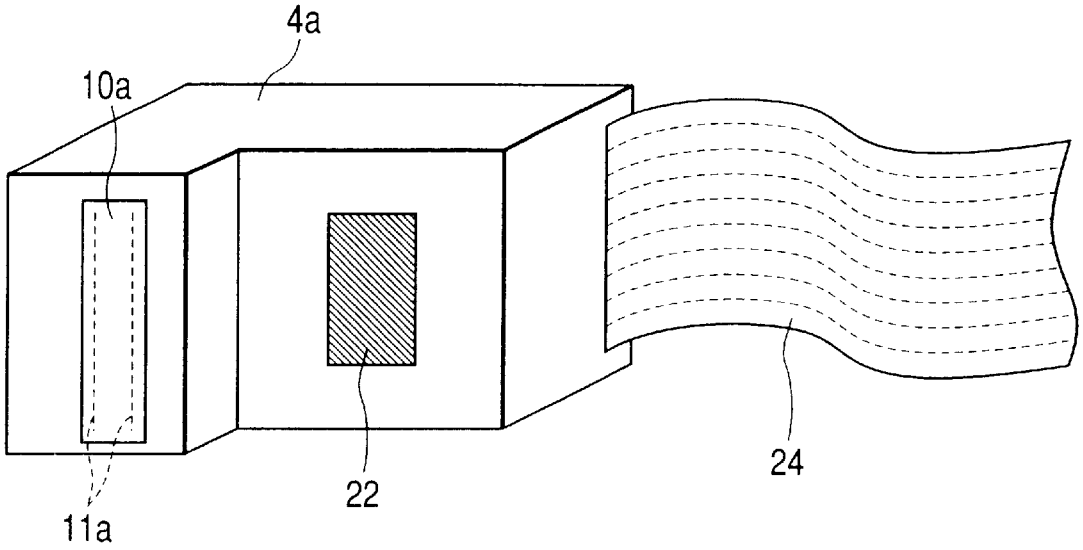
FIGS. 15A and 15B are perspective views of a recording cartridge according to a fourth embodiment of the present invention.
Figure 15B:
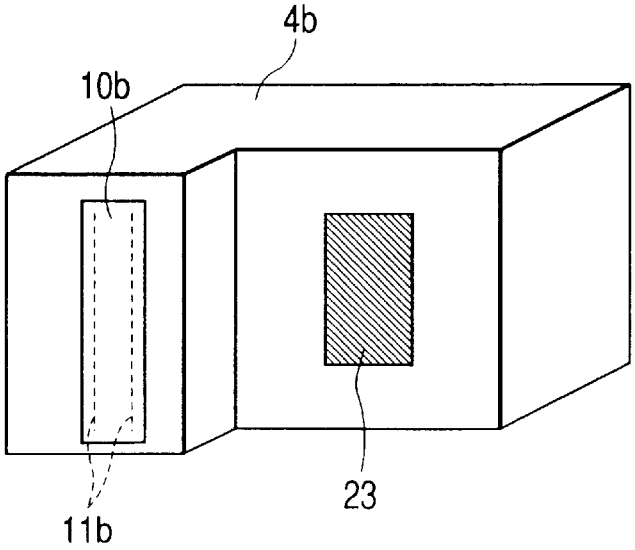

A recording apparatus according to a fourth embodiment of the present invention will now be described with reference to the drawings. FIGS. 15A and 15B are perspective views of recording cartridges according to the present embodiment, and portions overlapping those of the first embodiment in description are given the same reference characters and need not be described.

The recording cartridge 4*a* shown in FIG. 15A is provided with a light emitting element 22 of infrared light or the like which is information supplying and receiving means, and flexible wiring 24 is connected between it and the main body of the recording apparatus to thereby forward an electrical signal and image information. The flexible wiring 24 is directly connected to the recording cartridge 4*a* or connected to a carriage, not shown. On the other hand, the recording cartridge 4*b* shown in FIG. 15B is provided with a light receiving element 23 which is information supplying and receiving means for receiving the light emitted from the light emitting element 22.

The recording cartridge 4*a* scans on the recording sheet 1 in conformity with the electrical signal and image information sent thereto through the flexible wiring 24 and discharges ink to thereby record an image on the surface of the recording sheet 1. The electrical signal and image information sent at this time include those for the recording cartridge 4*a* and those for the recording cartridge 4*b*, and when there are those for the recording cartridge 4*b*, light is applied from the light emitting element 22 of the recording cartridge 4*a* toward the light receiving element 23 of the recording cartridge 4*b*. The recording cartridge 4*b* receives the electrical signal and the image information from the light receiving element 23, and scans on the recording sheet 1 in accordance therewith and discharges ink to thereby record an image on the back of the recording sheet 1.

While in the present embodiment, the light emitting element 22 and light receiving element 23 as the information supplying and receiving means have been described as effecting the exchange of data by light, use may be made of information supplying and receiving means using an electric wave. Also, the flexible wiring 24 may be connected to the recording cartridge 4*b* so that a signal may be sent from the recording cartridge 4*b* to the recording cartridge 4*a*.

Further, while in the present embodiment, the recording head 10 and the information supplying and receiving means have been shown as being provided on an integral recording cartridge 4, these may be discrete cartridges, and the recording head and information supplying and receiving means at the same side with respect to the recording sheet can be electrically connected together.

As described above, according to the present embodiment, at least one recording means for discharging the ink and at least one ink receiving device for receiving the discharged ink are disposed at each side of the recording sheet, whereby recording can be effected on both sides of the recording sheet at a time. Also, any ink flying to the outside of the recording sheet can be received and therefore, irrespective of both-side recording or one-side recording, blankless recording can be accomplished.

Also, the ink received by the ink receiving device is used by the recording means disposed at the same side as that ink receiving device, whereby the mutual ink support of the recording cartridges is made possible and the ink can be used efficiently, and a reduction in the running cost can be achieved.

Further, at least one information supplying and receiving means for giving and receiving the electrical signal and image information of each recording cartridge is disposed at each side of the recording sheet, whereby the recording cartridge connected to the main body of the recording apparatus by wire relaying can be made one and thus, the downsizing of the apparatus can be achieved. Also, the situation of the amount of ink, etc. can be communicated between the recording cartridges, and there can be provided a construction advantageous when effecting the above-described ink support.

What is claimed is:

1. An ink jet recording apparatus comprising:

conveying means for conveying a recording sheet;

first recording means for discharging ink to a first surface of the recording sheet conveyed by said conveying means to thereby record an image thereon, said first recording means being capable of reciprocally scanning in a direction intersecting with the direction of conveyance of the recording sheet;

second recording means for discharging ink to a second surface opposite to the first surface of the recording sheet conveyed by said conveying means to thereby record an image thereon, said second recording means being capable of reciprocally scanning in a direction intersecting with the direction of conveyance of the recording sheet;

a first ink receiving device for receiving the ink discharged from said second recording means, said first ink receiving device being disposed at the first surface side of the recording sheet and capable of reciprocally scanning in a direction intersecting with the direction of conveyance of the recording sheet; and a second ink receiving device for receiving the ink discharged from said first recording means, said second ink receiving device being disposed at the second surface side of the recording sheet and capable of reciprocally scanning in a direction intersecting with the direction of conveyance of the recording sheet.

2. An ink jet recording apparatus according to claim 1, wherein said first recording means and said first ink receiving device are provided in an integral recording cartridge.

3. An ink jet recording apparatus according to claim 1, wherein said second recording means and said second ink receiving device are provided in an integral recording cartridge.

4. An ink jet recording apparatus according to claim 1, wherein said first recording means and said second ink receiving device are at opposed positions when said second ink receiving device receives ink discharged from said first recording means.

5. An ink jet recording apparatus according to claim 1, wherein said second recording means and said first ink receiving device are at opposed positions when said first ink receiving device receives ink discharged from said second recording means.

6. An ink jet recording apparatus according to claim 1, wherein said first recording means and said second ink receiving device are at opposed positions when said first recording means records on an end portion of the recording sheet.

7. An ink jet recording apparatus according to claim 1, wherein said second recording means and said first ink receiving device are at opposed positions when said second recording means records on an end portion of the recording sheet.

8. An ink jet recording apparatus according to claim 1, wherein the ink received by said first ink receiving device is used by said first recording means.

9. An ink jet recording apparatus according to claim 1, wherein the ink received by said second ink receiving device is used by said second recording means.

10. An ink jet recording apparatus according to claim 1, wherein information supplying and receiving means for supplying or receiving an electrical signal or image information to or from said first and second recording means are provided at the first surface side of the recording sheet and the second surface side of the recording sheet.

11. An ink jet recording apparatus according to claim 1, wherein said first and second recording means electrically energize electro-thermal converting members, and discharge the ink by the utilization of heat energy generated by said electro-thermal converting members.

12. An ink jet recording apparatus according to claim 1, further comprising a first wiping device disposed at the first surface side of the recording sheet for wiping ink discharge ports of said second recording means, and a second wiping device disposed at the second surface side of the recording sheet for wiping the discharge ports of said first recording means.

13. An ink jet recording apparatus according to claim 12, wherein said first and second wiping devices can reciprocally scan in a direction intersecting with the direction of conveyance of the recording sheet.

14. An ink jet recording apparatus according to claim 12, wherein said first recording means, said first ink receiving device and said first wiping device are provided in an integral recording cartridge.

15. An ink jet recording apparatus according to claim 12, wherein said second recording means, said second ink receiving device and said second wiping device are provided in an integral recording cartridge.

16. An ink jet recording apparatus according to claim 12, wherein said first recording means and said second ink receiving device are at opposed positions when said second wiping device wipes said first recording means.

17. An ink jet recording apparatus according to claim 12, wherein said second recording means and said first ink receiving device are at opposed positions when said first wiping device wipes said second recording means.

18. An ink jet recording apparatus according to claim 12, wherein information supplying and receiving means for supplying or receiving an electrical signal or image information to or from said first and second recording means are provided at the first surface side of the recording sheet and the second surface side of the recording sheet.

19. An ink jet recording apparatus according to claim 12, wherein said first and second recording means electrically energize electro-thermal converting members in conformity with a signal, and discharge the ink by the utilization of heat energy generated by said electro-thermal converting members.

* * * * *

UNITED STATES PATENT AND TRADEMARK OFFICE

CERTIFICATE OF CORRECTION

PATENT NO. : 6,565,183 B2
DATED : May 20, 2003
INVENTOR(S) : Goto et al.

It is certified that error appears in the above-identified patent and that said Letters Patent is hereby corrected as shown below:

Drawings,
Sheet 3 of 15, at Step S2, "OFRECOVERY" should read -- OF RECOVERY --.

Signed and Sealed this

First Day of June, 2004

JON W. DUDAS
*Acting Director of the United States Patent and Trademark Office*